US009443688B2

(12) United States Patent
Whitney et al.

(10) Patent No.: US 9,443,688 B2
(45) Date of Patent: Sep. 13, 2016

(54) FUSE PROVIDING OVERCURRENT AND THERMAL PROTECTION

(75) Inventors: Stephen J. Whitney, Lake Zurich, IL (US); John E. C. Semana, Batangas (PH); Jamica P. Bato, Batangas (PH); Francisco De Guia, Laguna (PH); Bienvenido Salonga, Batangas (PH)

(73) Assignee: LITTELFUSE, INC., Chicago, IL (US)

( * ) Notice: Subject to any disclaimer, the term of this patent is extended or adjusted under 35 U.S.C. 154(b) by 63 days.

(21) Appl. No.: 13/569,851

(22) Filed: Aug. 8, 2012

(65) Prior Publication Data

US 2012/0299692 A1 Nov. 29, 2012

Related U.S. Application Data

(62) Division of application No. 12/247,690, filed on Oct. 8, 2008, now abandoned.

(60) Provisional application No. 60/978,580, filed on Oct. 9, 2007.

(51) Int. Cl.

| | |
|---|---|
| ***H01H 85/044*** | (2006.01) |
| ***H01H 85/041*** | (2006.01) |
| ***H01H 37/76*** | (2006.01) |
| ***H01H 85/06*** | (2006.01) |
| *H01H 85/046* | (2006.01) |
| *H01H 85/08* | (2006.01) |
| *H01H 85/143* | (2006.01) |

(52) U.S. Cl.

CPC ..... *H01H 85/0417* (2013.01); *H01H 37/761* (2013.01); *H01H 85/06* (2013.01); *H01H 85/046* (2013.01); *H01H 85/08* (2013.01); *H01H 85/143* (2013.01); *H01H 2037/768* (2013.01)

(58) Field of Classification Search

CPC ..... H01H 37/761; H01H 85/0417; H01H 85/06; H01H 85/046; H01H 2037/768; H01H 85/08; H01H 85/143

USPC ..... 337/161, 162, 292

See application file for complete search history.

(56) References Cited

U.S. PATENT DOCUMENTS 2,816,989 A * 12/1957 Sugden ..... H01H 85/10 29/868
3,858,142 A * 12/1974 Deelman et al. ..... 337/152

(Continued)

FOREIGN PATENT DOCUMENTS

CN 1873875 A 12/2003
CN 1477663 A 2/2004

(Continued)

OTHER PUBLICATIONS

Notification of the First Office Action in corresponding Chinese Patent Application No. 200810189334.2 dated Sep. 19, 2012.

(Continued)

*Primary Examiner* — Anatoly Vortman

(57) ABSTRACT

A fuse in one embodiment includes first and second leads. A fuse element provides electrical communication between the first and second leads. The fuse element includes a material with a melting point of less than 250.degree. C. and acts as both an overcurrent fuse and a thermal fuse by melting when subjected to a predetermined current or upon reaching a predetermined temperature. A body houses the fuse element and portions of the first and second leads.

6 Claims, 4 Drawing Sheets

(56) References Cited

U.S. PATENT DOCUMENTS

| | | | | | |
|---|---|---|---|---|---|
| 4,034,329 | A * | 7/1977 | Arikawa et al. | 337/163 |
| 4,057,774 | A * | 11/1977 | Arikawa et al. | 337/164 |
| 4,164,725 | A * | 8/1979 | Wiebe | 337/198 |
| 4,177,444 | A * | 12/1979 | Taki | 337/163 |
| 4,267,543 | A * | 5/1981 | Arikawa | 337/255 |
| 4,297,666 | A * | 10/1981 | Asdollahi | 337/163 |
| 4,417,226 | A * | 11/1983 | Asdollahi et al. | 337/273 |
| 4,445,106 | A * | 4/1984 | Shah | 337/163 |
| 4,517,544 | A * | 5/1985 | Spaunhorst | 337/164 |
| 4,560,971 | A * | 12/1985 | Oh | 337/164 |
| 4,628,293 | A * | 12/1986 | Marx | 337/216 |
| 4,670,729 | A * | 6/1987 | Oh | 337/262 |
| 4,680,567 | A * | 7/1987 | Edwards | 337/164 |
| 4,736,180 | A * | 4/1988 | Oh | 337/163 |
| 4,751,489 | A * | 6/1988 | Spaunhorst | 337/260 |
| 4,899,123 | A * | 2/1990 | Asdollahi et al. | 337/273 |
| 4,972,169 | A * | 11/1990 | Kalra | 337/163 |
| 5,142,262 | A * | 8/1992 | Onken | 337/163 |
| 5,179,436 | A * | 1/1993 | Asdollahi et al. | 337/203 |
| 5,235,307 | A * | 8/1993 | Oh | 337/228 |
| 5,287,079 | A * | 2/1994 | Bernardi et al. | 337/203 |
| 5,736,919 | A * | 4/1998 | Reeder | 337/227 |
| 5,898,358 | A * | 4/1999 | Tompkins et al. | 337/163 |
| 5,927,060 | A * | 7/1999 | Watson | 57/210 |
| 5,941,735 | A | 8/1999 | Bernardini | |
| 6,191,678 | B1 * | 2/2001 | Edwards | 337/163 |
| 6,462,472 | B1 | 10/2002 | Huang et al. | |
| 6,542,063 | B2 * | 4/2003 | Kawashima et al. | 337/203 |
| 6,552,646 | B1 * | 4/2003 | Wong | 337/252 |
| 6,762,670 | B1 * | 7/2004 | Yen | 337/203 |
| 6,930,585 | B2 * | 8/2005 | Kawazoe | 337/186 |
| 2002/0113684 | A1 * | 8/2002 | Arikawa et al. | 337/163 |
| 2004/0021499 | A1 * | 2/2004 | Iwamoto et al. | 327/525 |
| 2004/0104801 | A1 * | 6/2004 | Jollenbeck et al. | 337/159 |
| 2005/0258928 | A1 * | 11/2005 | Hase et al. | 337/14 |
| 2007/0132539 | A1 * | 6/2007 | Richter et al. | 337/14 |
| 2007/0236323 | A1 * | 10/2007 | Schmidt et al. | 337/297 |
| 2008/0084267 | A1 * | 4/2008 | Jollenbeck et al. | 337/246 |
| 2008/0272877 | A1 * | 11/2008 | Kwon | 337/198 |
| 2009/0108980 | A1 * | 4/2009 | Whitney et al. | 337/161 |
| 2010/0060406 | A1 * | 3/2010 | Kim et al. | 337/187 |
| 2011/0279218 | A1 * | 11/2011 | Salonga et al. | 337/187 |

FOREIGN PATENT DOCUMENTS

| | | | |
|---|---|---|---|
| EP | 0762455 | A1 | 12/1997 |
| JP | 6142046 | U | 3/1986 |
| JP | 07169381 | A | 4/1995 |
| JP | 09022802 | A | 1/1997 |
| JP | 11273520 | A | 10/1999 |
| JP | 2002015649 | A | 1/2002 |
| JP | 2002025402 | A | 1/2002 |

OTHER PUBLICATIONS

Notification of the Second Office Action in corresponding Chinese Patent Application No. 200810189334.2 dated Jun. 5, 2013.

Notification of the Third Office Action in corresponding Chinese Patent Application No. 200810189334.2 dated Dec. 12, 2013.

* cited by examiner

FUSE PROVIDING OVERCURRENT AND THERMAL PROTECTION

CROSS-REFERENCE TO RELATED APPLICATIONS

This is a Divisional of U.S. patent application Ser. No. 12/247,690 filed Oct. 8, 2008, which claims priority to and the benefit of U.S. Provisional Patent Application Ser. No. 60/978,580, filed Oct. 9, 2007 the entirety of which application is incorporated herein by reference.

BACKGROUND OF THE INVENTION

Field of the Invention

The present disclosure relates, generally, to fuses. More particularly, it relates to fuses providing both thermal and overcurrent protection in a single fuse.

In many applications it is desirable to have multiple types of fuses, so that, for example, the fuse will open if it exceeds a predetermined current or if it reaches a predetermined temperature. In the case of a short circuit, an overcurrent fuse will open if the current exceeds a predetermined value. In the case of a "soft short", where the current exceeds a normal operating value but is not high enough to open the overcurrent fuse, the thermal fuse will open if one or more components in the circuitry in proximity to the fuse becomes too hot. In many applications, particularly electronic devices, it would be desirable to combine the overcurrent protection and thermal protection in a single device to minimize the required space.

SUMMARY OF THE INVENTION

In various aspects, the present disclosure includes a fuse providing both overcurrent protection and thermal protection in a single fuse. In particular, at least a portion of the fuse may include a material with a predetermined melting point to provide thermal protection.

In one aspect, a fuse includes first and second leads. A fuse element provides electrical communication between the first and second leads. The fuse element includes a material with a melting point of less than 250.degree. C. and acts as both an overcurrent fuse and a thermal fuse by melting when subjected to a predetermined current or upon reaching a predetermined temperature. A body houses the fuse element and portions of the first and second leads.

In another aspect, a fuse includes first and second leads. An electrically insulating structure is disposed between the first and second leads. A wire is wrapped around the electrically insulating structure and provides electrical communication between the first and second leads. The wire acts as both an overcurrent fuse and a thermal fuse by melting when subjected to a predetermined current or upon reaching a predetermined temperature. A body houses the electrically insulating structure, the wire, and portions of the first and second leads.

In another aspect, a fuse includes first and second leads. A rod is disposed between the first and second leads. The rod includes an electrically insulating core portion and an electrically conducting coating portion. The electrically conducting coating portion provides electrical communication between the first and second leads. The electrically conducting coating portion acts as both an overcurrent fuse and a thermal fuse by melting when subjected to a predetermined current or upon reaching a predetermined temperature. A body houses the rod and portions of the first and second leads.

The fuse element, wire, conductive coating or low melting temperature lead can be made of a material, such as tin, SnIn52, SnZn9, SnCu0.7 and indium. The predetermined current can be 50 mA to 10 A, for example. The leads of the various embodiments are attached mechanically to the fuse element or rod in one embodiment.

In another aspect, a fuse includes first and second leads. At least a portion of one of the first and second leads includes a material with a melting point of less than 250.degree. C. The portion acts as a thermal fuse by melting upon reaching a predetermined temperature. A fuse element provides electrical communication between the first and second leads. The fuse element acts as an overcurrent fuse by melting when subjected to a predetermined current. A body houses the fuse element and portions of the first and second leads.

Additional features and advantages are described herein, and will be apparent from, the following Detailed Description and the figures.

DESCRIPTION OF EMBODIMENTS

Figure 1:
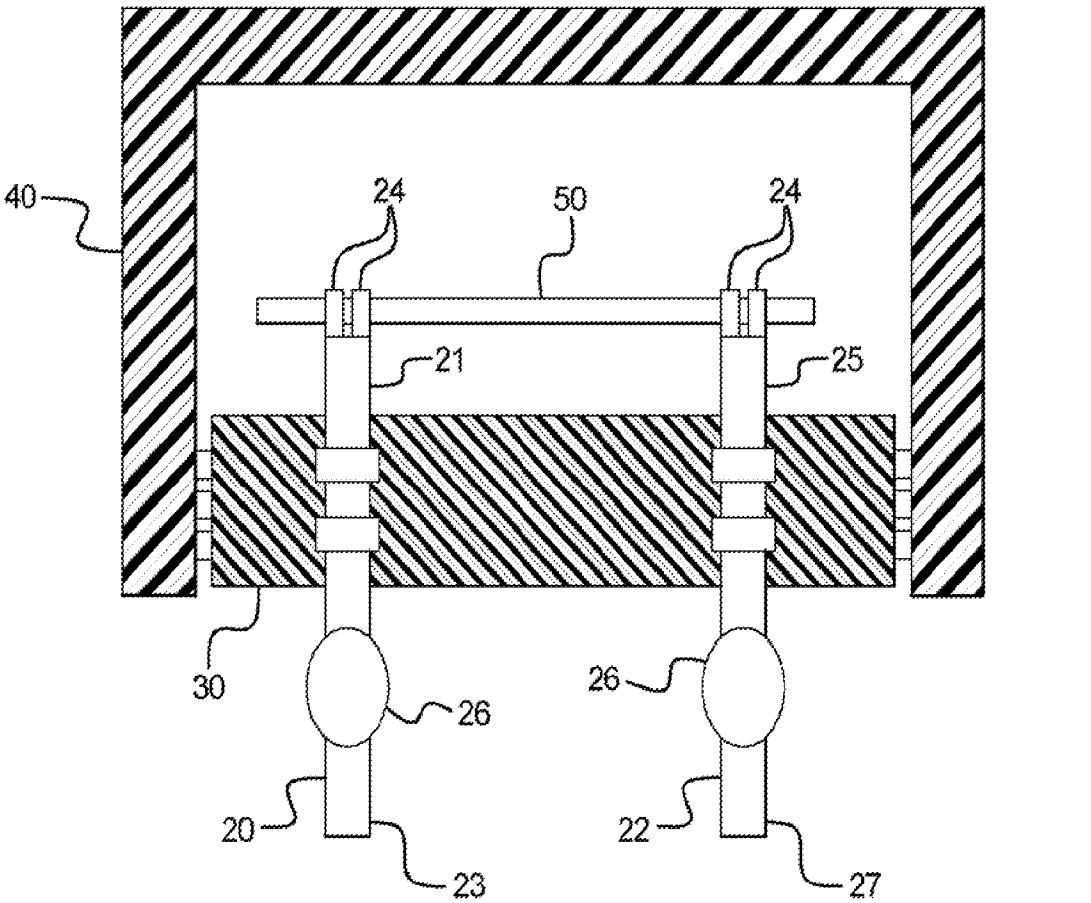
FIG. 1 is a schematic elevation view of a first embodiment of a fuse of the present disclosure.

Referring now to the drawings and, in particular, to FIG. 1, a schematic view of one embodiment of a fuse 10 is illustrated. The fuse 10 has a pair of leads 20 and 22, respectively. The leads 20 and 22 are made of a suitably conductive material, such as tin-plated copper. A base 30 and cover 40 provide a body or housing for the fuse 10. Leads 20, 22 are disposed through the base 30. The base 30 may be made of any suitable insulating material, and may be molded or cast around the leads 20, 22. The cover 40 is made of a conventional insulating material, such as a polyamide. A portion of the base 30 and cover 40 has been cutaway for purposes of illustrating the fuse circuit of the present disclosure. Although the embodiment shown in FIG. 1 is arranged as a lead-type fuse, other arrangements, such as cartridge-type, are possible. Further, leads 20 and 22 could be formed into female connectors configured to mate with male electrodes projecting, for example, from a printed circuit board. Typical dimensions for the fuse housing 10 are two mm to ten mm in length, width, and depth.

A fuse element 50 is in electrical communication with the ends 21, 25 of leads 20, 22. The fuse element 50 may be generally rod or cylindrically shaped, but other shapes are possible. A typical dimension for fuse element 50 is five mm in length and 0.2 mm in diameter. The fuse element 50 in one embodiment is comprised of a material with a melting point of less than 250.degree. C. The fuse element 50 acts as both an overcurrent fuse and a thermal fuse by melting when subjected to either a predetermined current or upon reaching a predetermined temperature. The predetermined current may be about 120 mA. Other possible predetermined current values may be in the range of 50 mA to 10 A. The predetermined current is determined by the resistance and melting temperature of the fuse element 50 and thus depends on the material, size and shape of the element 50.

The predetermined melting temperature may be about 157.degree. C. The predetermined temperature is primarily dependent on the melting point of the fuse element 50, although the size and shape of the fuse element 50 may determine the time it takes for the element 50 to melt. The predetermined melting temperature may be a variety of desired levels, including less than 250.degree. C., less than 225.degree. C., less than 200.degree. C., and less than 175.degree. C. In one embodiment, the fuse element 50 is made of indium to provide a melting temperature of about 157.degree. C. Alternatively, fuse element 50 could be made of tin to provide a melting temperature of about 232.degree. C. Various alloys could also be used for fuse element 50, for example SnIn52, SnZn9 or SnCu0.7 with melting temperatures of about 118.degree. C., 199.degree. C. and 227.degree. C., respectively.

The fuse element 50 may be mechanically connected to leads 20, 22 by fingers 24. Mechanical connection may be preferable to soldering in many applications to avoid melting the fuse element 50. The fingers 24 may bend or be crimped around the fuse element 50 to secure the element 50 adjacent the ends 21, 25 of leads 20, 22. Other methods of attaching fuse element 50 to leads 20, 22 are possible, such as electrically conductive adhesive. Fingers 24 may be integrally formed with leads 20, 22, or alternatively mechanically attached thereto, such as by soldering or welding. Leads 20, 22 may have swaged or flattened portions 26 adjacent ends 23, 27. Flattened portions 26 allow the fuse 10 to be press fit through a hole in a substrate, such as a circuit board. This is particularly useful in embodiments where fuse element 50 includes a low melting point material, in that it would be difficult to solder such a fuse to a substrate or printed circuit board without melting the fuse element 50.

Fuse 10 may be construed in a similar manner as a conventional fuse, with care taken to avoid subjecting the fuse element 50 to a temperature near its melting point. The fuse 10 may be constructed by first providing leads 20, 22 of the appropriate shape and size. Base 30 is then molded around the leads 20, 22. Alternatively, base 30 may be cast around the leads 20, 22. Fuse element 50 is then connected to leads 20, 22 by bending or crimping fingers 24 around the fuse element 50. A cover 40 is then inserted around the fuse element 50 and secured to the base 30. Prior to inserting cover 50, it may be partially or completely filled with an arc suppressing material such as silica sand or ceramic powder to enhance the current and voltage interrupting properties of the fuse.

In operation, current flows between leads 20, 22 and through fuse element 50. If the current exceeds a predetermined value, the resistance in fuse element 50 causes the element 50 to heat up and melt, thus breaking the circuit between leads 20 and 22. Likewise, if a current fault provides an increased current that is less than the predetermined overcurrent condition but causes one or more components in the circuitry in proximity to the fuse to overheat, fuse element 50 will melt, thus breaking the circuit.

Figure 2:
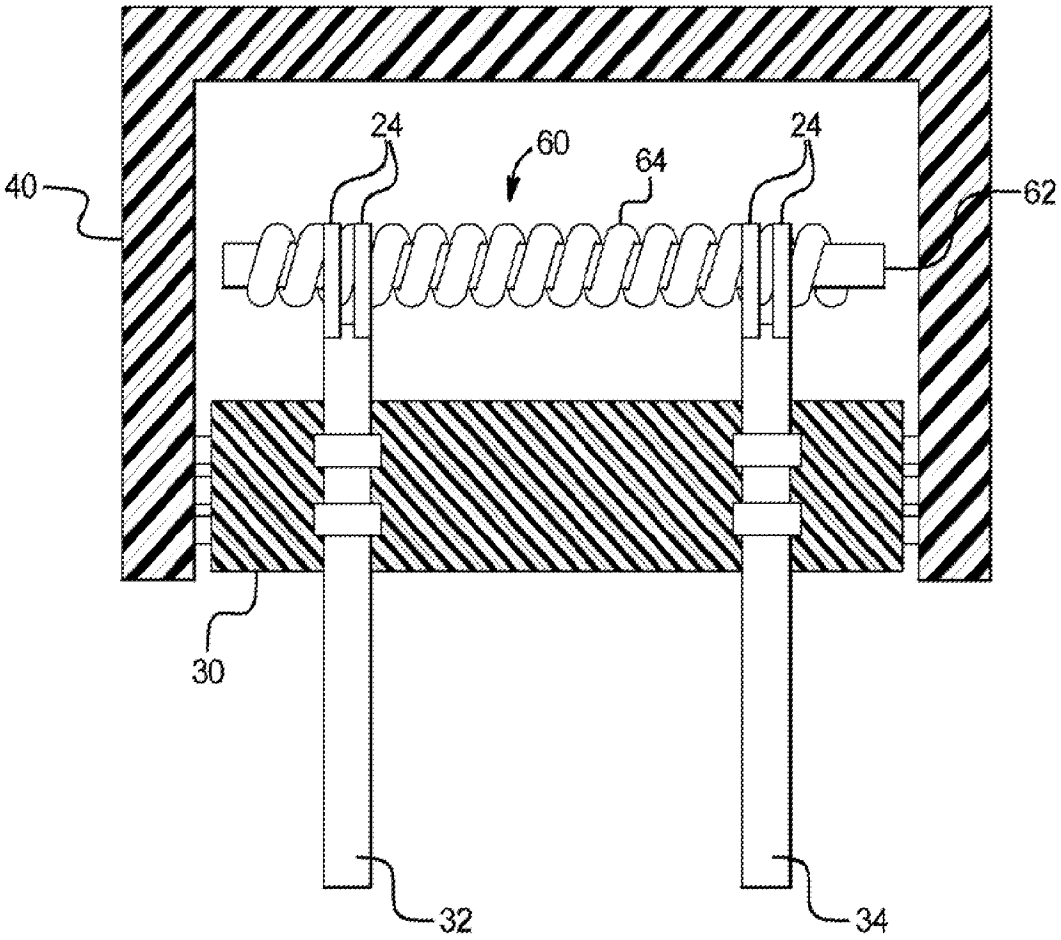
FIG. 2 is a schematic elevation view of a second embodiment of a fuse of the present disclosure.

A second embodiment of a fuse 12 is shown in FIG. 2. Fuse 12 is in most ways similar to fuse 10. It is different in the construction of the fuse element and leads. Fuse 12 includes a fuse element 60 with an electrically insulating structure 62 disposed between the first and second leads 32, 34. A wire 64 is spirally wrapped around the electrically insulating structure 62 and provides electrical communication between the first and second leads 32, 34. The electrically insulating structure 62 may be made of a resilient, compressible insulating material, such as an elastomer, e.g., silicone, or alternatively, ceramic yarn. The use of a compressible material for electrically insulating structure 62 provides a good mechanical press-fit connection with fingers 24. The wire 64 acts as both an overcurrent fuse and a thermal fuse by melting when subjected to either a predetermined current or upon reaching a predetermined temperature. Depending on the size and dimensions of fuse 12, the spiral wire 62 may provide more desirable dimensions (such as length), compared to element 50 of FIG. 1, to control the desired maximum current. The fuse 12 may include straight leads 32, 34 as shown in FIG. 2, or alternatively it may include flattened portion like portions 26 shown in FIG. 1.

Like fuse 10, the fuse element 60 of fuse 12 provides both overcurrent and thermal protection. Wire 64 will melt when subjected to either a predetermined current or upon reaching a predetermined temperature. The predetermined temperature is primarily dependent on the melting point of the material of wire 64, although the size and shape of the wire 64 may determine the time it takes for the wire to melt. Wire 64 may be comprised of indium or any of the other previously mentioned alloys. Typical dimensions for wire 64 are five mm in total length and 0.2 mm in diameter, with a suitable number of total turns. The predetermined melting temperature may be any of the previously described melting temperatures for fuse 10. Fuse 12 may be constructed in a manner similar to conventional fuses.

Figure 3:
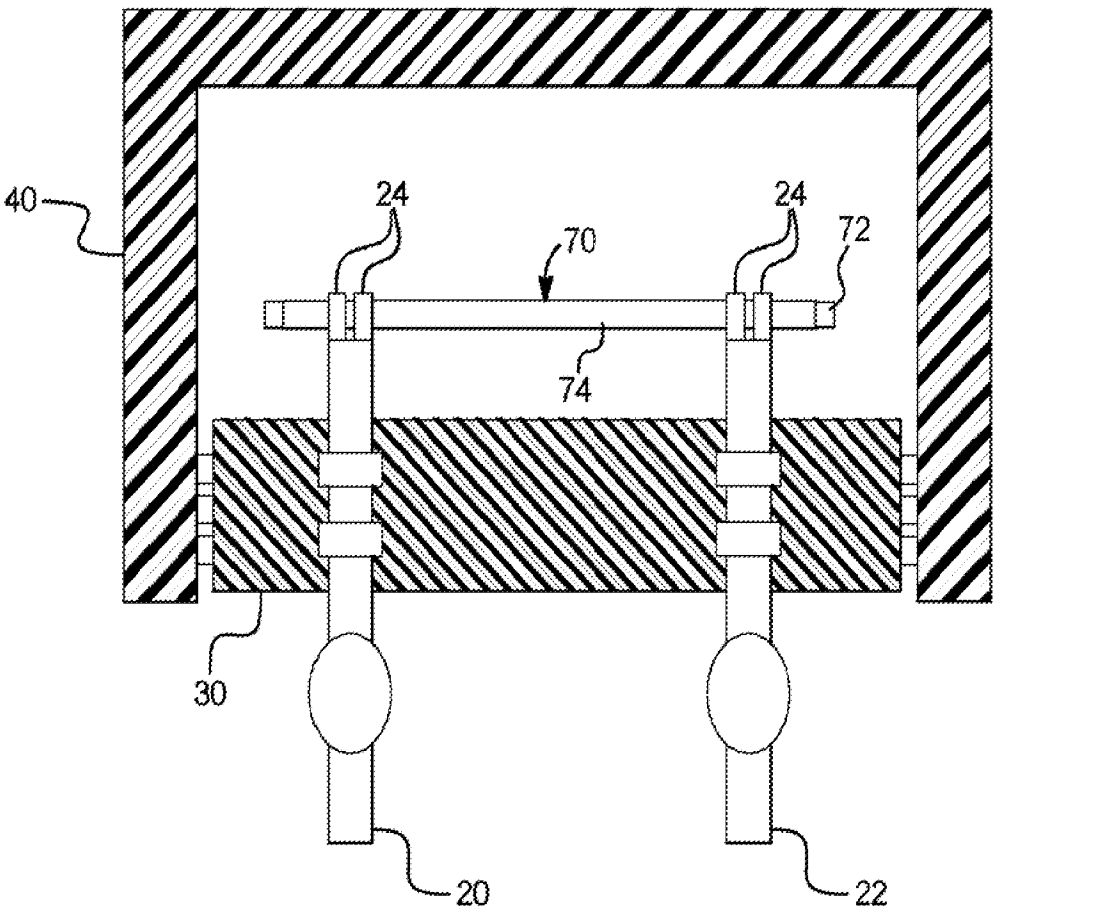
FIG. 3 is a schematic elevation view of a third embodiment of a fuse of the present disclosure.

A third embodiment of a fuse 14 is shown in FIG. 3. Fuse 14 is in most ways similar to fuse 10. It is different in the construction of the fuse element 70. Fuse 14 includes a rod 70 (or other generally longitudinally extending member) disposed between the first and second leads 20, 22. The rod 70 includes an electrically insulating core portion 72 and an electrically conducting coating portion 74. The electrically conducting coating portion 74 provides electrical communication between the first and second leads 20, 22. The electrically conducting coating portion 74 of rod 70 may be applied by any conventional technique, including, but not limited to, plating, sputtering, and vapor deposition. The remaining portions of fuse 14 may be constructed in a conventional fashion.

Like fuses 10 and 12, the rod element 70 of fuse 12 provides both overcurrent and thermal protection. The electrically conducting coating portion 74 acts as both an overcurrent fuse and a thermal fuse by melting away from the insulating core portion 72 when subjected to either a predetermined current or upon reaching a predetermined temperature, thus breaking the circuit between leads 20 and 22. The predetermined temperature is primarily dependent on the melting point of the material of coating portion 74, although the thickness and shape of the coating portion 74 may determine the time it takes for it to melt. The predetermined melting temperature may be any one of the previously described temperature levels. Coating portion 74 may be comprised of indium or any of the other previously mentioned alloys. Insulating core portion 72 may be comprised of any suitable insulating material, such as silicone or ceramic yarn. Typical dimensions for rod 70 are 5 mm in total length and 0.2 mm in diameter. Rod element 70 is connected to leads 20 and 22 as described herein.

Figure 4:
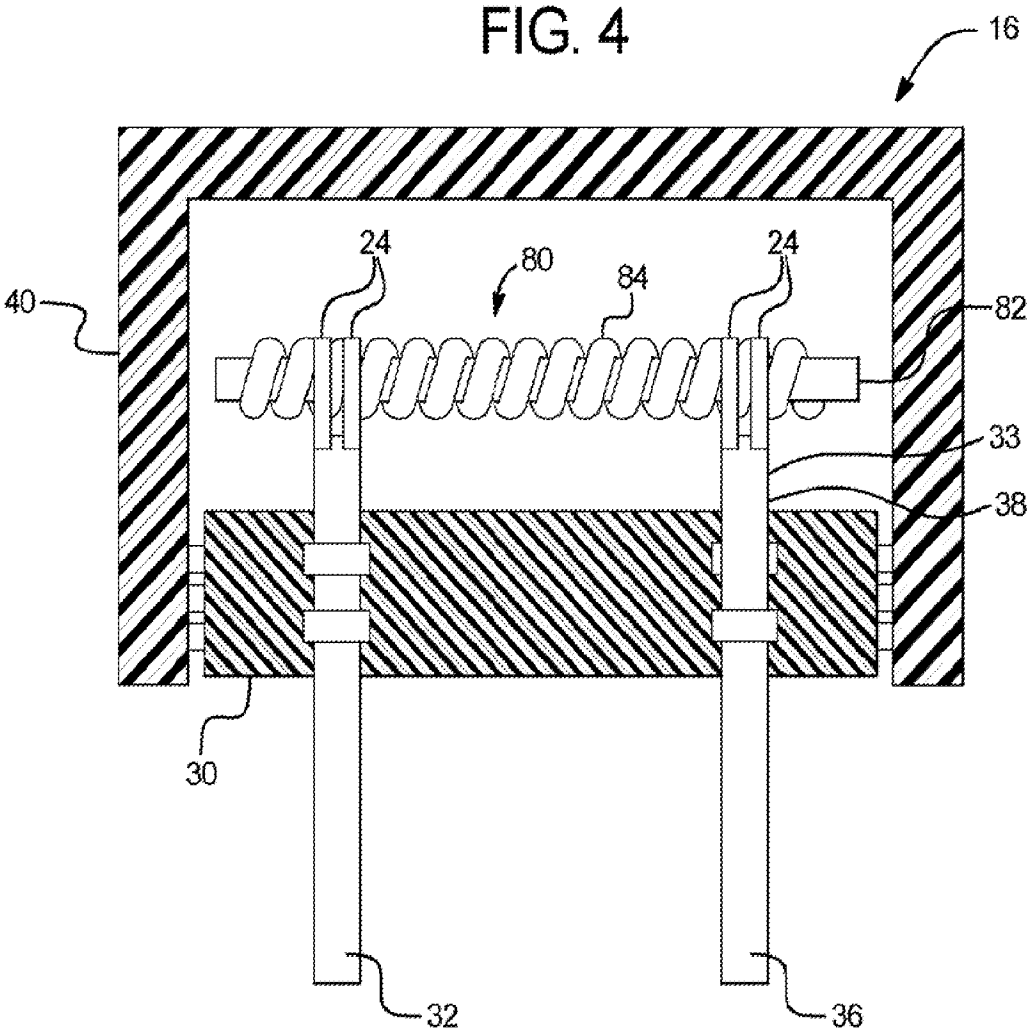
FIG. 4 is a schematic elevation view of a fourth embodiment of a fuse of the present disclosure.

A fourth embodiment of a fuse 16 is shown in FIG. 4. The base 30 and housing 40 of fuse 16 are essentially similar to those of fuse 10. Fuse 16 is different in the construction of the fuse element 80 and the leads 32, 36. Fuse element 80 includes an electrically insulating structure 82 disposed between the first and second leads 32, 36. A wire 84 is spirally wrapped around the electrically insulating structure 82 and provides electrical communication between the first and second leads 32, 34. The wire 84 acts as an overcurrent fuse, much like a conventional fuse. The wire 84 may be constructed of copper or tin-plated copper. The electrically insulating structure 82 may be made of silicone or ceramic yarn. In addition, at least a portion of one of the leads 32, 36 includes a lower melting point material that acts as a thermal fuse. As shown in FIG. 4, lead 36 includes portion 38 adjacent end 33 of fuse element 80. Portion 38 is fashioned from a material, such as indium or any of the other previously described alloys, that melts when a predetermined temperature is reached, thus breaking the circuit between leads 32 and 36. Other elements, such as finger 24, may also be made from a low-melting point material such as indium. Alternatively, one or both of leads 32, 36 may be entirely constructed from a low-melting point material.

Fuse 16 may be constructed in much the same manner as a conventional fuse. However, since portion 38 includes a low-melting point material, the use of soldering may be limited in order to avoid melting the low-melting point material. Other methods of connection, such as conductive adhesives (e.g. conductive epoxies or silicones), may be used instead. Additionally, if either of the leads 32, 36 includes a low-melting point material, it is preferred that the base 30 be cast instead of molded to avoid undesirable melting of the leads.

It should be understood that various changes and modifications to the presently preferred embodiments described herein will be apparent to those skilled in the art. Such changes and modifications can be made without departing from the spirit and scope of the present subject matter and without diminishing its intended advantages. It is therefore intended that such changes and modifications be covered by the appended claims.

What is claimed is:

1. A fuse comprising:

a first lead, wherein the first lead having a swaged or flattened portion for securing the first lead to a substrate without the aid of solder;

a second lead, wherein the second lead having a swaged or flattened portion for securing the second lead to a substrate without the aid of solder;

an electrically insulating structure disposed between the first and second leads;

a wire wrapped around the electrically insulating structure and providing electrical communication between the first and second leads, the wire acting as both an overcurrent fuse and a thermal fuse by melting when subjected to a predetermined current or upon reaching a predetermined temperature, the electrically insulating structure and wire forming a fuse element; and a body housing the electrically insulating structure, the wire, and portions of the first and second leads, wherein the wire is coupled to the first lead and the second lead by respective sets of fingers bent or crimped about the wire and insulating structure, wherein at least one of the first and second leads includes a first section made from a material having a relatively lower melting point than a material of a remainder of the at least one of the first and second leads, the first section disposed adjacent the respective sets of fingers, wherein the wire is retained by the sets of fingers without the aid of solder, wherein a space between the body and the fuse element is at least partially filled with an arc suppressing material, the arc suppressing material configured to enhance the current and voltage interrupting properties of the fuse, wherein a solder material connects the sets of fingers to the first and second leads, respectively, wherein the first and second leads comprise the sets of fingers adjacent the electrically insulating structure and the electrically insulating structure comprises a compressible material, wherein sets of fingers are press fit around the electrically insulating structure, wherein the electrically insulting structure is compressed where the sets of fingers are press fit around the electrically insulating structure.

2. The fuse of claim 1, wherein the electrically insulating structure is rod-shaped.

3. The fuse of claim 1, wherein the wire is made of at least one material selected from the group consisting of: tin, SnIn52, SnZn9B, SnCu0.7 and indium.

4. The fuse of claim 1, wherein the predetermined current is from 50 mA to 10 A.

5. The fuse of claim 1, wherein the wire comprises a material with a melting point between 110 degrees C. and 250 degrees C.

6. The fuse of claim 1, wherein the space between the body and the fuse element is completely filled with an arc suppressing material.

* * * * *